United States Patent [19]

Hong

[11] Patent Number: 4,797,037

[45] Date of Patent: Jan. 10, 1989

[54] PILING

[75] Inventor: Lee P. Hong, Kuala Lumpur, Malaysia

[73] Assignee: Pilecon Engineering Berhad, Kuala Lumpur, Malaysia

[21] Appl. No.: 43,725

[22] Filed: Apr. 29, 1987

[30] Foreign Application Priority Data

Apr. 30, 1986 [GB] United Kingdom ..... 8610617

[51] Int. Cl.[4] ..... E02D 5/30

[52] U.S. Cl. ..... 405/255; 405/232; 405/251

[58] Field of Search ..... 405/251, 252, 231, 232, 405/250, 255, 256, 257

[56] References Cited

U.S. PATENT DOCUMENTS

| | | | |
|---|---|---|---|
| 2,430,879 | 11/1947 | Kohn | 405/243 |
| 2,698,520 | 1/1955 | Lloyd | 405/252 |
| 3,046,749 | 7/1962 | Blessey | 405/251 |
| 3,316,724 | 5/1967 | Tsuzuki | 405/251 |
| 3,593,532 | 7/1971 | Grazel | 405/252 |
| 4,127,002 | 11/1978 | DeWitt | 405/239 |
| 4,659,256 | 4/1987 | Bullivant | 405/230 |

FOREIGN PATENT DOCUMENTS

| | | | |
|---|---|---|---|
| 952436 | 3/1964 | United Kingdom | 405/252 |
| 2067633 | 7/1981 | United Kingdom | 405/252 |

*Primary Examiner*—Dennis L. Taylor

*Attorney, Agent, or Firm*—Pollock, VandeSande & Priddy

[57] ABSTRACT

A reinforced pre-cast concrete pile includes an intermediate cast-in plate attached to cast-in reinforcements of the pile. Following driving of a column of the piles, if the plate of the uppermost pile is above a reference terrain level, then the upwardly projecting part is cut off and that part severed at the lower face of its plate and such upper half is re-used in a subsequent column of piles.

10 Claims, 2 Drawing Sheets

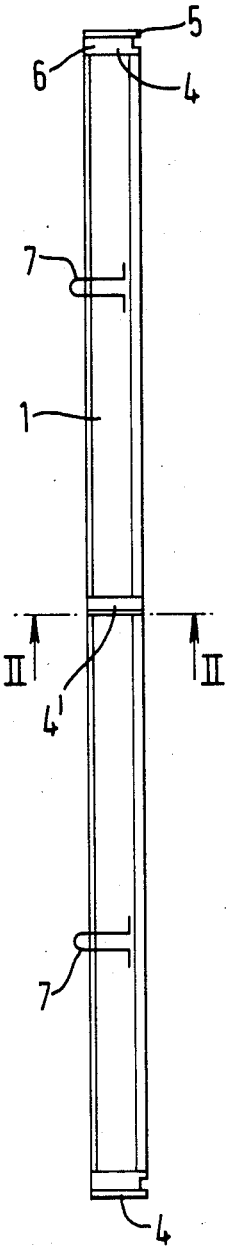
FIG. 1.
FIG. 2.
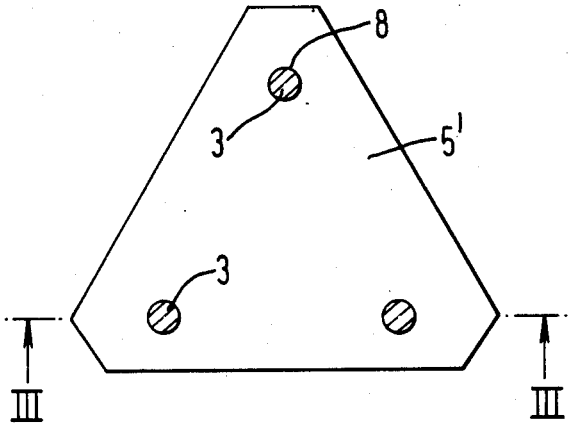

PILING

BACKGROUND OF THE INVENTION

1. Field of the Invention

This invention relates to a precast concrete pile and to a piling method utilizing the same.

2. Description of Invention

In driving of pre-cast concrete piles, it is conventional to connect a plurality of piles together end-to-end in turn until firm ground has been struck by the lower end of the lower pile, and then to sever off any part of the uppermost pile projecting significantly above the desired level. Such a system is disclosed in, for example, GB No. 783,624. Sometimes, the severed part can be a commercially significant fraction of the uppermost pile, often more than half of the uppermost pile. This severed part may be thrown away. On the other hand, it can be re-used by breaking up the severed end zone and re-casting it with extra reinforcement and with a driving plate transverse to the pile. However, the latter course of action is expensive and time-consuming.

A way of avoiding the expense of waste or of time-consuming work has been proposed in U.S. Pat. No. 2,430,879 and U.S. Pat. No. 4,127,002, in both of which a shell enclosure is mounted atop the uppermost pile co-axially therewith, the column of piles is driven to bearing depth, and the shell enclosure is cut off at a reference terrain level and then filled with a hardenable plastic material, such as concrete.

However, those proposals are disadvantageous in requiring an accurate forecast of the bearing depth, since, if after driving of the shell enclosure, it becomes clear that one or more precast piles should have been added beforehand, the situation can only be rectified with great difficulty, if at all.

In the system disclosed in GB No. 783,624, a reinforced. concrete driving head is either stressed to the uppermost pile section of precast pile sections of a prestressed pile, or rests thereupon in the manner of a dolly, the head being removable for repeated use as a driving head. The head bears upon a flat, mild steel ring upon the uppermost pile section, the ring serving as a top end anchoring plate for stressing wires of the pile.

SUMMARY OF THE INVENTION

According to one aspect of the present invention, there is provided a reinforced, pre-cast concrete pile including reinforcing means cast into and reinforcing said pile and extending substantially the length of said pile, and a plate-like, metal member attached to said reinforcing means and cast into said pile and extending in the pile transversely of the pile at a location intermediate the ends of the pile.

According to another aspect of the present invention, there is provided a piling method, comprising driving into the ground a reinforced, precast concrete pile including reinforcing means cast into and reinforcing said pile and extending in the pile transversely of the pile at a location intermediate the ends of the pile, severing the pile at a location below said member, and removing the upper severed section of the pile.

BRIEF DESCRIPTION OF THE DRAWINGS

In order that the invention may be clearly understood and readily carried into effect, reference will now be made, by way of example, to the accompanying drawings, in which:

FIG. 1 shows a side elevation of a reinforced, pre-cast concrete pile,

FIG. 2 shows a section taken on the line II—II of FIG. 1, and

DESCRIPTION OF THE PREFERRED EMBODIMENT

Figure 3:
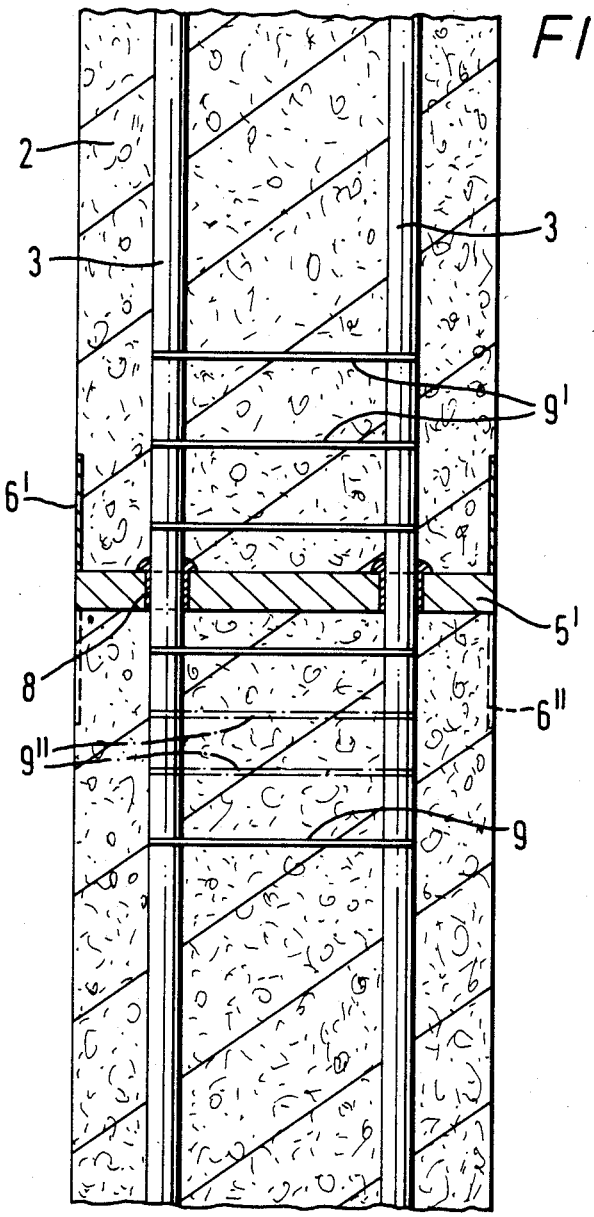
FIG. 3 shows a longitudinal section taken on the line III—III of FIG. 2.

Referring to the drawings, the pile 1 is largely of concrete 2 of substantially triangular cross-section and reinforced with three mild steel bars 3 welded at their ends to end caps 4 which each serve to reinforce the relevant pile end, to provide a driving anvil, and also for use in connecting the pile to another such pile arranged vertically above or below the pile shown. For these purposes, each cap 4 includes a mild steel driving and connecting plate 5 to which is welded an encircling mild steel band 6. Lifting hoops 7 are cast into the concrete 2. Half-way along the pile 1 there is cast in with the concrete 2 a cap 4' substantially identical to the caps 4, except that it is not intended to be connected to another pile end and except that its plate 5' is formed with three circular holes 8 receiving the bars 3, which are there welded to the plate 5'. The encircling steel band 6' extends upwardly from the plate 5'. Distributed along the bars 3 are mild steel stirrups 9, although these are distributed more thickly at 9' immediately above the plate 5', in order to provide extra reinforcement in that region.

In pile driving, one or more piles may be connected together in turn end-to-end, these piles being of a known kind with the cap 4' and the extra reinforcement 9' omitted. When it is believed that firm ground will soon be struck, then one or more piles as shown in the drawings are added in turn to the column until the firm ground is struck. Assuming that the pile shown in FIG. 1 is the uppermost pile in the column, if the level at which the pile is to terminate in the region of ground level is above the level of the cap 4', then, after driving, the upwardly protruding portion of the pile is cut off and probably discarded. However, if that level is at or below the cap 4', then, only is the upwardly projecting part cut off, but also that part is itself severed at the lower face of the plate 5', so that the upper half of the pile 1 can be re-used, giving a significant financial saving, and also a saving in time because that part is ready for immediate re-use. Such upper half is re-used as the lowermost pile of another column of piles, with the cap 4' being at the lower end of that re-used half.

It will be understood that, in the case of a relatively long pile 1, more than one cap 4' and its associated extra reinforcement 9' may be provided at intervals along the pile. Furthermore, in order to ensure that driving of the pile 1 in an inverted manner does not prevent the re-usable fraction from being reused, the cap 4' can have welded thereto a downwardly projecting, encircling steel band 6'', and extra reinforcement 9'' may be provided immediately below the plate 5', as shown in FIG. 3.

I claim:

1. A reinforced, pre-cast concrete pile including pile end reinforcing metal end caps, reinforcing means cast into and reinforcing said pile and extending substantially the length of said pile, and a metal member attached to said reinforcing means and cast into said pile, extending in the pile transversely of the pile at a location remote from ends of the pile and formed as a plate element able to act as a metal end cap of a truncated pile formed by cutting the pile immediately below said metal member.

2. A pile according to claim 1, wherein said member extends over substantially the whole cross-sectional area of said pile.

3. A pile according to claim 1, wherein said member has attached thereto an external metal skirt extending in one direction along said pile from said member.

4. A pile according to claim 3, wherein said member has attached thereto a second external metal skirt extending from said member along said pile oppositely to said one direction.

5. A pile according to claim 3, wherein said reinforcing means includes extra reinforcement radially inwards of said skirt.

6. A pile according to claim 4, wherein said reinforcing means includes extra reinforcement radially inwards of said second skirt.

7. A pile according to claim 1, wherein said reinforcing means includes extra reinforcement arranged adjacent to said member at one face thereof.

8. A pile according to claim 7, wherein said reinforcing means includes extra reinforcement arranged adjacent to said member at the other face thereof.

9. A pile according to claim 1, and further comprising a second said metal member attached to said reinforcing means and cast into said pile and extending in said pile transversely of said pile at a second location remote from said ends, formed as a plate element able to act as a metal end cap of a truncated pile formed by cutting the pile immediately below the metal member.

10. A piling method, comprising driving into the ground a reinforced, pre-cast concrete pile including pile end reinforcing metal end caps, reinforcing means cast into and reinforcing said pile and extending substantially the length of said pile, and a metal member attached to said reinforcing means and cast into said pile, extending in the pile transversely of the pile at a location remote from the ends of the pile and formed as a plate element able to act as a metal end cap of a truncated pile formed by cutting the pile immediately below the metal member, severing the pile at a location below said member and providing said plate element as an end cap of a truncated pile thus formed from the upper severed section of the pile.

* * * * *